US005353612A

United States Patent [19]

Noguchi et al.

[11] Patent Number: 5,353,612

[45] Date of Patent: Oct. 11, 1994

[54] SINGLE-TUB WASHING MACHINE

[75] Inventors: Takeo Noguchi, Sakai; Miwa Yoshida; Kazuo Katayama, both of Osaka, all of Japan

[73] Assignee: Sharp Kabushiki Kaisha, Osaka, Japan

[21] Appl. No.: 101,316

[22] Filed: Aug. 3, 1993

[30] Foreign Application Priority Data

| | | | |
|---|---|---|---|
| Aug. 3, 1992 | [JP] | Japan | 4-206402 |
| Aug. 4, 1992 | [JP] | Japan | 4-207796 |
| May 19, 1993 | [JP] | Japan | 5-117420 |

[51] Int. Cl.[5] ..... D06F 33/02

[52] U.S. Cl. ..... 68/12.02; 68/12.14; 68/133

[58] Field of Search ..... 68/12.01, 12.02, 12.05, 68/12.14, 12.18, 133, 131, 23.6

[56] References Cited

U.S. PATENT DOCUMENTS

| | | | |
|---|---|---|---|
| 3,772,902 | 11/1973 | Noguchi | 68/23.6 |
| 4,782,544 | 11/1988 | Nystuen et al. | 68/12.14 |
| 4,843,671 | 7/1987 | Hirooka et al. | 68/12.14 |
| 5,133,200 | 7/1992 | Tanaka et al. | 68/12.14 |
| 5,207,764 | 5/1993 | Akabane et al. . | |

FOREIGN PATENT DOCUMENTS

| | | | |
|---|---|---|---|
| 0247995 | 12/1987 | European Pat. Off. . | |
| 55-50638 | of 1980 | Japan . | |
| 54-12095 | 8/1980 | Japan . | |
| 59-44299 | 3/1984 | Japan . | |
| 61-9878 | 3/1986 | Japan . | |
| 0249116 | 10/1990 | Japan . | |
| 3-63098 | 3/1991 | Japan | 68/12.14 |
| 2058148 | 4/1981 | United Kingdom . | |

*Primary Examiner*—Frankie L. Stinson

[57] ABSTRACT

A single-tub washing and dehydrating machine includes a microcomputer control means which, when the drain hole is blocked with laundries to be dehydrated in a dehydrating process to cause reduction of pressure inside an air trap and thereby a reset water level is detected erroneously, provides an error indication immediately after the detection, or controls the pulsator to effect a predetermined corrective operation for correcting the position of the laundries to be dehydrated inside the washing/dehydrating tub and thereafter provides an error indication if the correction is judged as impossible. Alternatively, the single-tub washing and dehydrating machine further includes a filter case having a plurality of slit holes, and a lint filter having a removable sack-shaped net while the lint filter is fitted detachably to the filter case. Still, in an alternate single-tub washing and dehydrating machine of the present invention, the taper ratios of the peripheral wall formed on the inner side of the washing/dehydrating tub and the grooves provided in the peripheral wall are limited to a range within 1/60 to 1/40, and the taper ratio of the grooves is different from and larger than the ratio of the peripheral wall while the ratio of the total width of grooves to the inner circumference of the washing/dehydrating tub is to be 1/9 or more.

3 Claims, 14 Drawing Sheets

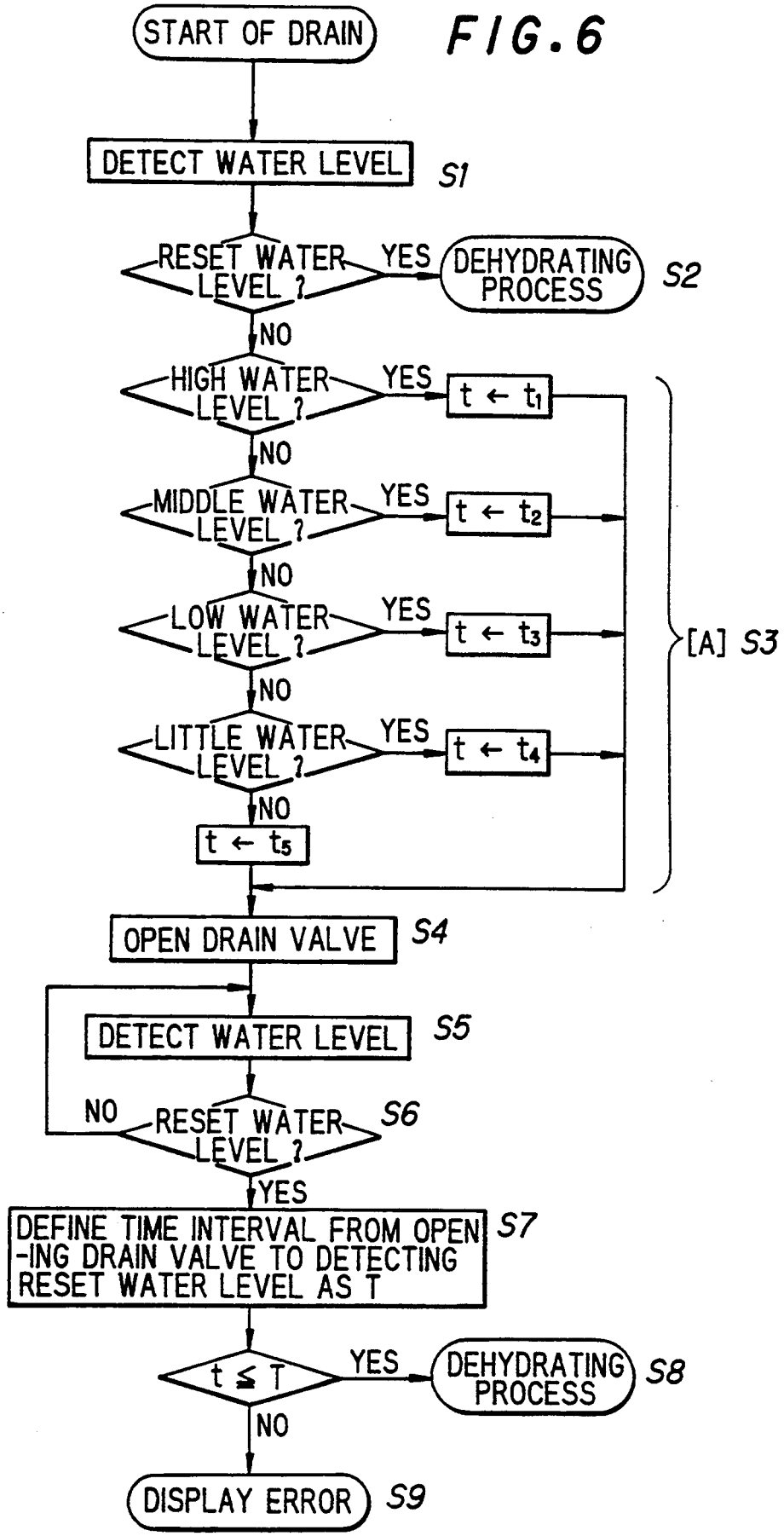
FIG. 6
START OF DRAIN
DETECT WATER LEVEL
S1
RESET WATER LEVEL ?
YES
DEHYDRATING PROCESS
S2
NO
HIGH WATER LEVEL ?
YES
t ← t1
NO
MIDDLE WATER LEVEL ?
YES
t ← t2
NO
LOW WATER LEVEL ?
YES
t ← t3
NO
LITTLE WATER LEVEL ?
YES
t ← t4
NO
t ← t5
[A] S3
OPEN DRAIN VALVE
S4
DETECT WATER LEVEL
S5
NO
RESET WATER LEVEL ?
S6
YES
DEFINE TIME INTERVAL FROM OPEN -ING DRAIN VALVE TO DETECTING RESET WATER LEVEL AS T
S7
t ≦ T
YES
DEHYDRATING PROCESS
S8
NO
DISPLAY ERROR
S9

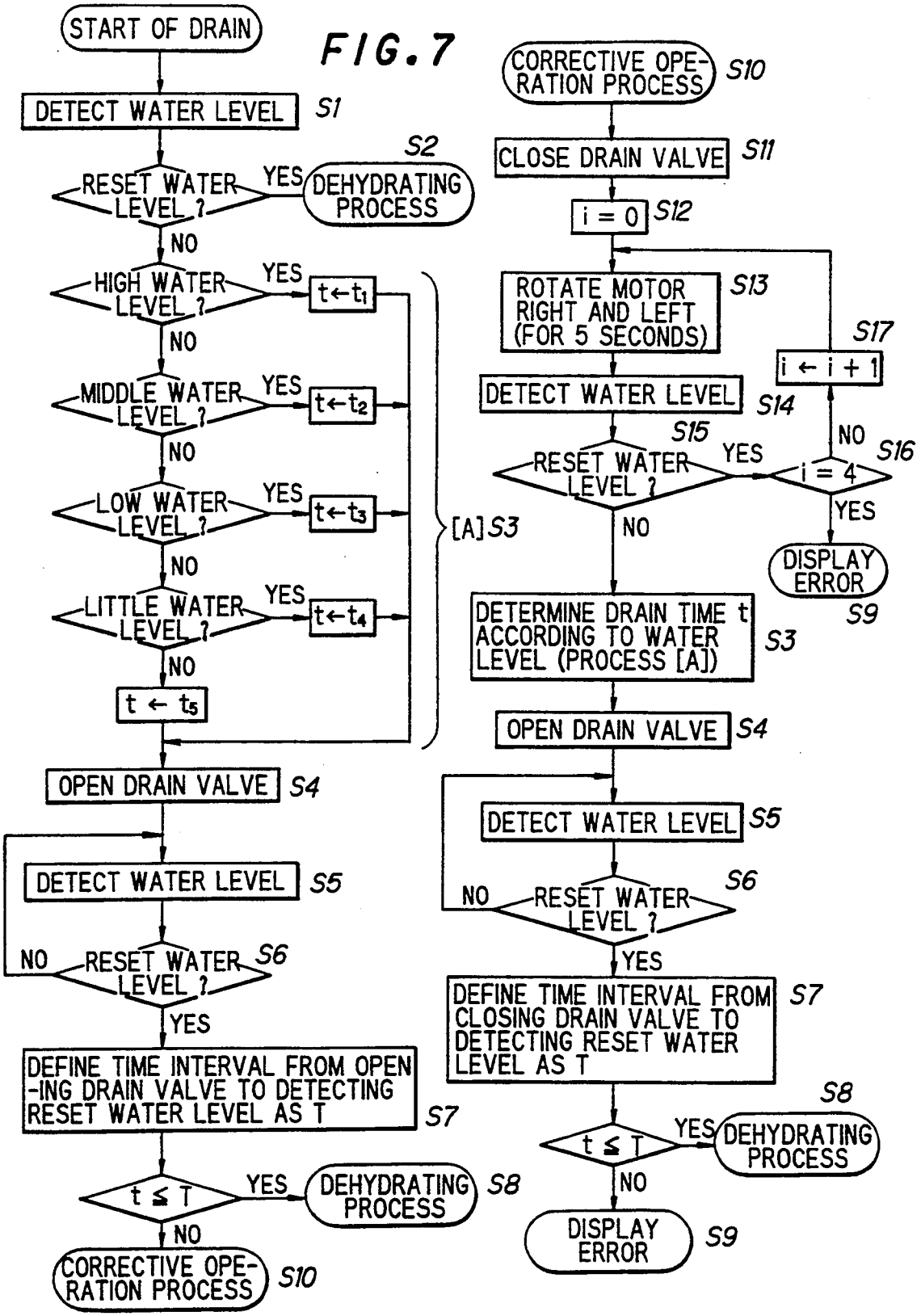
FIG. 7
START OF DRAIN
DETECT WATER LEVEL
S1
RESET WATER LEVEL ?
YES
S2
DEHYDRATING PROCESS
NO
HIGH WATER LEVEL ?
YES
t←t1
NO
MIDDLE WATER LEVEL ?
YES
t←t2
NO
LOW WATER LEVEL ?
YES
t←t3
NO
LITTLE WATER LEVEL ?
YES
t←t4
NO
t ← t5
[A] S3
OPEN DRAIN VALVE
S4
DETECT WATER LEVEL
S5
NO
RESET WATER LEVEL ?
S6
YES
DEFINE TIME INTERVAL FROM OPENING DRAIN VALVE TO DETECTING RESET WATER LEVEL AS T
S7
t ≤ T
YES
DEHYDRATING PROCESS
S8
NO
CORRECTIVE OPERATION PROCESS
S10
CORRECTIVE OPERATION PROCESS
S10
CLOSE DRAIN VALVE
S11
i = 0
S12
ROTATE MOTOR RIGHT AND LEFT (FOR 5 SECONDS)
S13
DETECT WATER LEVEL
S14
S15
RESET WATER LEVEL ?
YES
i = 4
S16
NO
S17
i ← i + 1
YES
DISPLAY ERROR
S9
NO
DETERMINE DRAIN TIME t ACCORDING TO WATER LEVEL (PROCESS [A])
S3
OPEN DRAIN VALVE
S4
DETECT WATER LEVEL
S5
NO
RESET WATER LEVEL ?
S6
YES
DEFINE TIME INTERVAL FROM CLOSING DRAIN VALVE TO DETECTING RESET WATER LEVEL AS T
S7
S8
t ≤ T
YES
DEHYDRATING PROCESS
NO
DISPLAY ERROR
S9

SINGLE-TUB WASHING MACHINE

BACKGROUND OF THE INVENTION

1. Field of the Invention

The present invention relates to a single-tub washing machine, and more specifically to a fully automatic single-tub washing and dehydrating machine built in with a microcomputer and suitable for eliminating an erroneous operation thereof during dehydration. The invention further relates to a proposal of a new filter unit for use in the fully automatic single-tub washing and dehydrating machine.

2. Description of the Related Art

A typical fully automatic washing and dehydrating machine performs successive steps of water supplying, washing/rinsing (i.e., agitating) and dehydrating to complete a washing operation. In effecting dehydrating operations in the rinsing step and the dehydrating step, initially, the washing water is drained. One of conventional control of the process is described, for example, in Japanese Patent Application Laid-Open Sho 59 No. 44299. In this disclosure, discharge of water is started in a first phase of a draining step, and then when water level sensor detects a predetermined "reset water level", the discharge of water is continued until a predetermined time (for example, 30 seconds) passes away, thereafter the dehydrating step is started.

FIG. 1 is a sectional view showing a construction of such a single-tub washing machine. In the figure, a dehydrated water-receiving tub 142 is elastically supported through a supporting rod 143 and a spring 144 in an external tub 141. A washing/dehydrating tub 145, having dehydration holes 145*a* in the upper portion thereof, is mounted rotatably in the dehydrated water-receiving tub 142, while a pulsator 146, having a washing impeller 146*a* on a front side thereof and a pumping impeller 146*b* on a rear side thereof, is provided rotatably in the bottom center of the washing/dehydrating tub 145.

Reference numeral 154 designates a drain valve, which will be opened when water in the washing/dehydrating tub 145 is discharged outside from the machine through a drain hose 155. A water level sensor, designated at 147, detects pressure in an air trap 156 disposed in the course of a draining path 150 (upstream of drain valve 154) by way of a pipe 148, and sends out a detected signal for a control unit 149, which in turn regulates the drain valve 154. A driving motor designated at 151 drives the washing/dehydrating tub 145 and pulsator 146 via a belt 153 and mechanism portion 152.

Next, operations of each component during dehydration will be described. At dehydration, drain valve 154 is opened in response to the signal outputted from control unit 149, and the washing water is discharged through drain hose 155 in the course of drain path 150. Then, washing/dehydrating tub 145 is spun at a high speed to cause centrifugal force to extract the remaining water. The thus extracted water is discharged through dehydration holes 145*a* provided in the upper part of tub 145 to dehydrated water-receiving tub 142 and discharged outside the machine through drain hose 155.

Meanwhile, many proposals as to fully automatic washing machines have been presented for preventing vibration and scattering of laundries due to imbalance arising during dehydrating process, the prevention of stack of the dehydration holes with the laundries and the protection of lowering of dehydrating efficiency.

One of examples of such proposals that employ3 a dehydration tub with a number of dehydration holes is disclosed in Japanese Patent Publication Hei 2 No. 49116, in which the imbalance of the washing is eliminated by causing the pulsator to make intermittent rotations of not more that one revolution during the drainage in the dehydrating step.

On the other hand, Japanese Patent Publication Sho 61 No. 9878 discloses a method using a dehydrating tub without hole, in which water is discharged from dehydrating clearance between the tub and a balancer disposed at the upper side of the dehydrating tub.

A publication of Japanese Patent Application Laid-Open Sho 54 No. 120958 discloses a method in which water is discharged from dehydration holes disposed in the upper portion of the dehydrating tub.

Of these conventional methods, the above cited Japanese Patent Publication Sho 61 No. 9878, in particular, proposes that the taper angle of the dehydrating tub is effectively set at 30° or less in order to prevent the scattering of the laundries, the stack of water-discharging holes with the washing, the lowering of dehydrating efficiency, etc. In this embodiment, the taper angle is practically set at 2° to 3° in order to improve the dehydrating efficiency. Therefore, an inclination angle of a ridge face of the inner wall in the dehydrating tub is set such that, the following relation is satisfied:

$$\text{the taper angle} < \text{the inclination angle} \leqq 30°.$$

In the above cited Japanese Patent Application Laid-Open Sho 54 No. 120958, if the taper angle is 2° or more, a plurality of holes are provided in upper portion of grooves or in the upper boundary portion of the washing/dehydrating tub. In contrast, when the taper angle is less than 2°, there is provided at least one dehydration hole inside each groove in a range of from the bottom to the upper portion of the washing/dehydrating tub and one dehydration hole at the above end of each groove.

A typical dehydrating tub provided with many dehydration holes is generally tapered at a ratio of 1/100 or less.

Generally, a typical automatic washing machine is provided with a filtering device in order to remove dust and lint attached to washed clothes from the washing water. Examples of conventional washing machines provided with a filtering device will be described with reference to respective sectional views.

Referring to FIG. 2, the washing machine is provided with a water tub 131 containing washing water. This machine is operated to perform the washing by turning a pulsator 132 while a pumping impeller 132*a* provided on the rear side is caused to suck the washing water from water tub 131 through a number of holes provided in a flange 133 as shown in FIG. 2. The thus sucked water is ejected into a lifting path 136 that is defined between an inner tub 134 and a filter cover 135 so that lint and dust are collected by a lint filter 137.

On the other hand, in a single-tub washing machine, which holds washing water only in a washing/dehydrating tub, it is necessary to circulate the washing water in the washing/dehydrating tub in order to collect lint and dust. One example of such means is proposed in Japanese Utility Model Application Laid-Open Sho 55 No. 50638, in which, as shown in FIG. 3, a flow path is defined by a channel 122 provided for a washing- /dehydrating tub 121 and a filter 124 extending to the vicinity of the periphery of a pulsator 123. The circulating water is sucked by a pumping impeller 127 via through-holes 125 to collect lint and dust by using a brush-like projection 126 mounted on filter 124 in the flow path.

In the course of the drainage described above, when drain valve 154 is opened to start the dehydration, wet laundry materials, such as clothes to be dehydrated may sometimes be stuck on drain holes 150*a* that serve as entrances of drain path 150. This causes drain path 150 to be blocked. In such a case, the washing water can not flow through drain path 150 downstream of drain holes 150*a* and the air remains in drain path 150. At the time, the pressure inside air trap 156 is lowered so that water level sensor 147 erroneously detects the state as a reset water level. With this detection, a microcomputer in the conventional control, directs the operation to advance to the next step. In this case, the operation goes to the dehydrating step in which the dehydrating tub 145 containing the water starts to spin. Since the dehydrating tub 145 can not be rotated at a high speed until the water is completely discharged, the dehydrating efficiency might possibly be lowered to a great extent.

In a case where the wet laundries are offset and in an imbalance condition inside dehydrating tub 145, the tub 145 is caused to vibrates when the dehydration is started (or while dehydrating tub 145 rotates at a low speed) if the water is completely drained out. As a result, an imbalance detecting switch is turned on to execute a corrective process. On the other hand, if the water is not completely discharged, the vibration does not occur due to the water left among the wet laundries when the dehydration is started. However, vibration starts to occur as the water is gradually drained and the rotation of the dehydrating tub is accelerated to an increased speed. As a result, an abnormal vibration may occur. Therefor, in either case, the dehydrating process can not be performed normally.

Moreover, of the above, the prior art single-tub washing machine associated with FIG. 3, in particular, has a drawback that relatively small lint can not be collected due to the construction. In addition, there is another drawback that efficiency of the collection of the lint is decreased when the water level is low (i.e., a small amount of clothes is washed) since through-holes 125 are positioned in relatively higher portions of washing-/dehydrating tub 121. Further, the flow path defined by the extension of filter 124 successively extends up to only the vicinity of the outside of pulsator 123. Therefore, water flows of the sucked current and of the ejected current by pulsator 123 collide with one another to decrease a sucking efficiency. Consequently, the efficiency of the collection of the lint is still more worsened.

SUMMARY OF THE INVENTION

It is therefore an object of the present invention to provide a singe-tub washing machine including a microcomputer control means for performing a corrective operation or providing an error indication to remove a blocking of drain holes when the drain hole is blocked during a drain process in a single-tub washing and dehydrating machine, and enabling avoidance of an erroneous operation during dehydration and improvement of an efficiency of the dehydration.

It is another object of the present invention to provide a fully automatic single-tub washing and dehydrating machine which is provided with a filter device constructed to enhance a collection efficiency of lint and the like.

A further object of the present invention is to provide a single-tub washing machine which allows the dehydration process after the washing or rinsing process to be effected with a reduced vibration and thereby improves the efficiency of the dehydration.

The present invention has been achieved to accomplish the above objects, and in accordance with a first aspect of the present invention, a single-tub washing and dehydrating machine includes:

a washing/dehydrating tub, having a peripheral wall with no hole except with dehydration holes or dehydrating clearance disposed in the vicinity of the upper boundary thereof, having a drain hole disposed in the bottom portion thereof, and being spun when dehydration is effected;

a pulsator having a pumping impeller on the back side thereof, disposed in the bottom of the washing-/dehydrating tub for agitating water with laundries to be washed when washing is effected; and a dehydrated water-receiving tub holding and enclosing the washing/dehydrating tub, and the drain hole discharges water while being communicated with a drain pipe sealingly against the dehydrated water-receiving tub. The single-tub washing and dehydrating machine, further includes a microcomputer control means which, when the drain hole is blocked with laundries to be dehydrated in a dehydrating process to cause reduction of pressure inside an air trap and thereby a reset water level is detected erroneously, provides an error indication immediately after the detection, or controls the pulsator to effect a predetermined corrective operation for correcting the position of the laundries to be dehydrated inside the washing-/dehydrating tub and thereafter provides an error indication if the correction is judged as impossible.

In accordance with a second gist of the present invention, a single-tub washing and dehydrating machine includes:

a washing/dehydrating tub, having a peripheral wall with no hole except with dehydration holes or dehydrating clearance disposed in the vicinity of the upper boundary thereof, having a drain hole disposed in the bottom portion thereof, and being spun when dehydration is effected;

a pulsator having a pumping impeller on the back side thereof, disposed in the bottom of the washing-/dehydrating tub for agitating water with laundries to be washed when washing is effected; and a dehydrated water-receiving tub holding and enclosing the washing/dehydrating tub, and the drain hole discharges water while being communicated with a drain pipe sealingly against the dehydrated water-receiving tub. The single-tub washing and dehydrating machine further includes: a microcomputer control means which, when the drain hole is blocked with laundries to be dehydrated in a dehydrating process to cause reduction of pressure inside an air trap and thereby a reset water level is detected erroneously, provides an error indication immediately after the detection, or controls the pulsator to effect a predetermined corrective operation for correcting the position of the laundries to be dehydrated inside the washing- /dehydrating tub and thereafter provides an error indication if the correction is judged as impossible;

a filter cover defining a water driving channel from a portion of the side wall of the washing/dehydrating tub to a bottom portion underneath the pulsator;

a filter case having a plurality of slit holes being provided in a lower portion of the filter cover detachably therefrom; and a lint filter having a sack-shaped net, disposed in a space defined by the washing/dehydrating tub, the filter cover and the filter case and fitted detachably to the filter case.

In accordance with a third aspect of the present invention, a single-tub washing and dehydrating machine includes:

a washing/dehydrating tub, having a peripheral wall with no hole except with dehydration holes or dehydrating clearance disposed in the vicinity of the upper boundary thereof, having a drain hole disposed in the bottom portion thereof, and being spun when dehydration is effected;

a pulsator having a pumping impeller on the back side thereof, disposed in the bottom of the washing-/dehydrating tub for agitating water with laundries to be washed when washing is effected; and a dehydrated water-receiving tub holding and enclosing the washing/dehydrating tub; and the drain hole discharges water while being communicated with a drain pipe sealingly against the dehydrated water-receiving tub. The single-tub washing and dehydrating machine further includes a microcomputer control means which, when the drain hole is blocked with laundries to be dehydrated in a dehydrating process to cause reduction of pressure inside an air trap and thereby a reset water level is detected erroneously, provides an error indication immediately after the detection, or controls the pulsator to effect a predetermined corrective operation for correcting the position of the laundries to be dehydrated inside the washing/dehydrating tub and thereafter provides an error indication if the correction is judged as impossible. The single-tub washing and dehydrating machine is characterized in that the washing/dehydrating tub has a plurality of vertical grooves on the peripheral wall thereof, the grooves has a taper ratio different from and larger than a taper ratio of the peripheral wall, both the taper ratios of the grooves and the peripheral wall are limited within 1/60 to 1/40, and the washing/dehydrating tub with grooves is constructed such that a relation between the total width NL of all the grooves and the inside circumference ($2\pi R$) of the washing/dehydrating tub suffices $NL \geqq 2\pi R/9$, or the ratio of NL to $2\pi R$ is 1/9 or more, where N and L indicate the number of the grooves and a width of each groove, respectively, and R is a radius of the washing/dehydrating tub.

In the fully automatic washing and dehydrating machine having the construction set forth heretofore, in case the wet laundries block the drain holes in the drain process and the pressure in an air trap is reduced, the microcomputer control means is operated to detect a reset water level. If a time required for detecting the reset water level is less than a time required for draining according to the water level when the drainage is started, the microcomputer control means is operated to provide an error indication immediately by using a display unit or a buzzer. Alternatively, the pulsator is driven to correct a position of the wet laundries in the tub for a predetermined period. If it is impossible to correct after repetitions of the corrective operations, the microcomputer control means is operated to provide an error indication. As a result, it is possible to avoid a reduced efficiency of the dehydration, or an abnormal vibration of the dehydrating tub in the dehydration without delay and fail. Therefore, operation time can be reduced and the water can be saved.

Further, since the water driving channel for suction extends Under a lower portion of the pulsator in the construction, there is no collision between a sucked-in flow and an ejected flow when the pulsator rotates. As a result, an efficient pumping operation can be carried out. On the other hand, since flowing slit holes provided in the filter case are positioned substantially at the bottom of the washing/dehydrating tub, the filter can provide an excellent filtration effect in the range of a low water level to a high water level. Additionally, since the lint filter is formed with a sack-shaped net, this ensures to collect any lint no matter how fine it is.

Moreover, in the present invention, the taper ratios of the peripheral wall formed on the inner side of the washing/dehydrating tub and the grooves provided in the peripheral wall are limited to a range within 1/60 to 1/40, and the taper ratio of the grooves is different from and larger than the ratio of the peripheral wall. Therefore, the water separated from the laundries by the centrifugal force is raised along the grooves to be discharged from the tub while the laundries are pressed against the inner wall without rising. As a result, the thus constructed wall and grooves of the invention can provide a dehydrating efficiency equivalent to a case in which a tub without grooves has a peripheral wall having the same taper as of the grooves of the invention. Further, taking the ratio of the total width of grooves to the inner circumference of the washing/dehydrating tub to be 1/9 or more, can improve the dehydrating efficiency.

BRIEF DESCRIPTION OF THE DRAWINGS

FIG. 6 is a flowchart for executing an error indication when an abnormality is detected after the start of drainage;

FIG. 7 is a flowchart for performing a corrective operation when an abnormality is detected after the start of drainage and for displaying an error if the abnormality can not be corrected;

DESCRIPTION OF THE PREFERRED EMBODIMENTS

One embodiment of the present invention will be described in detail with reference to the drawings.

Figure 4:
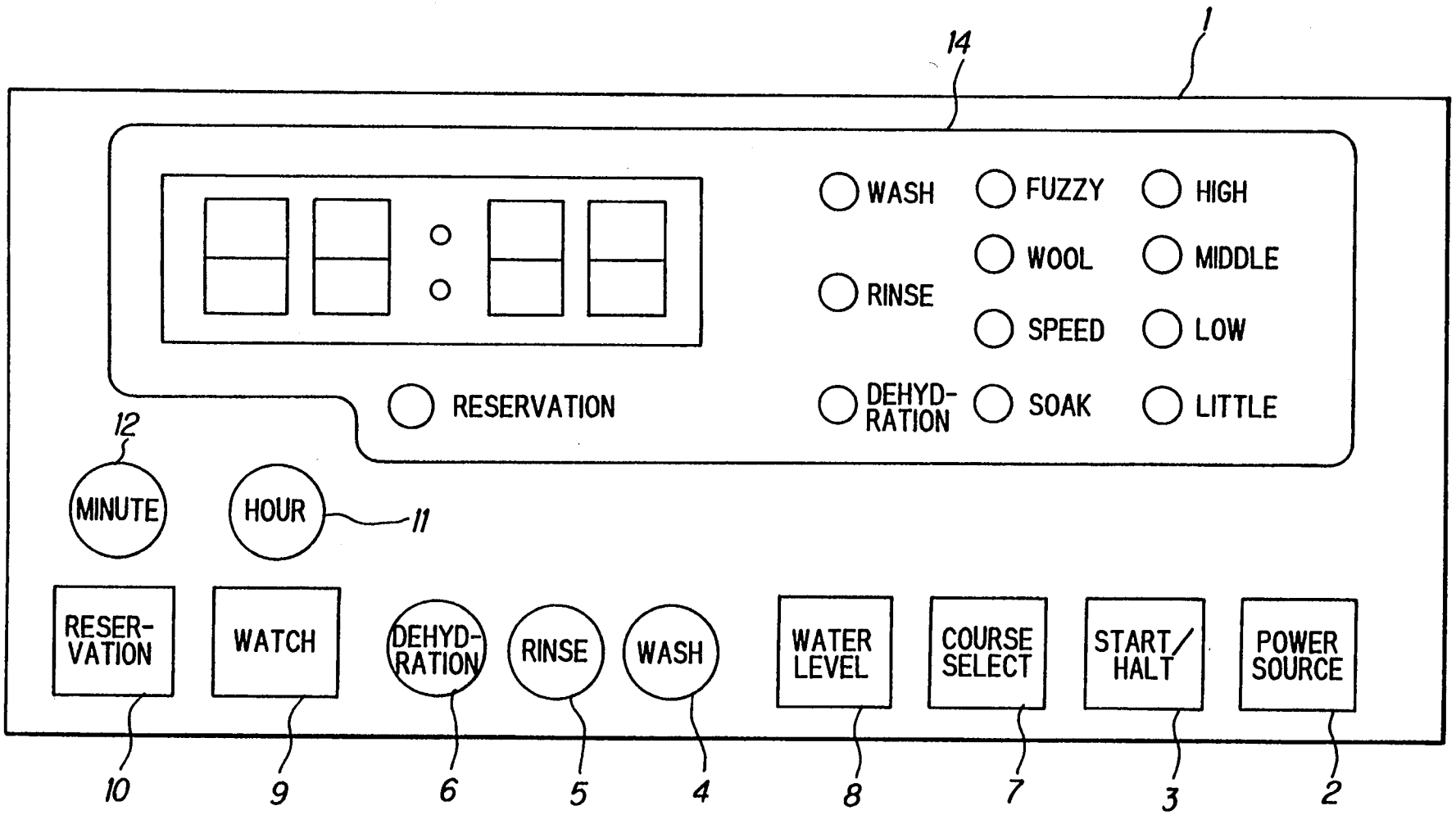
FIG. 4 is an arrangement plan showing one example of a control panel in a washing machine of the present invention.

FIG. 4 is an arrangement plan showing one example of a control panel in a washing machine of the present invention. Referring to FIG. 4, reference numeral 1 designates a control panel. Provided on control panel 1 are a power source switch 2, a start/halt switch 3, a wash key 4, a rinse key 5, a dehydration key 6, a course selection key 7 and a water level setting key 8. Control panel 1 further includes a clock key 9 for setting a current time, a reservation key 10 for setting a time to be reserved, an hour setting key 11 for setting a number of hour when a time is set by clock key 9 or reservation key 10, a minute setting key 12 for setting a number of minute, and a display portion 14 for displaying a set time, a remaining time during the operation of the machine and selected items of modes.

Figure 5:
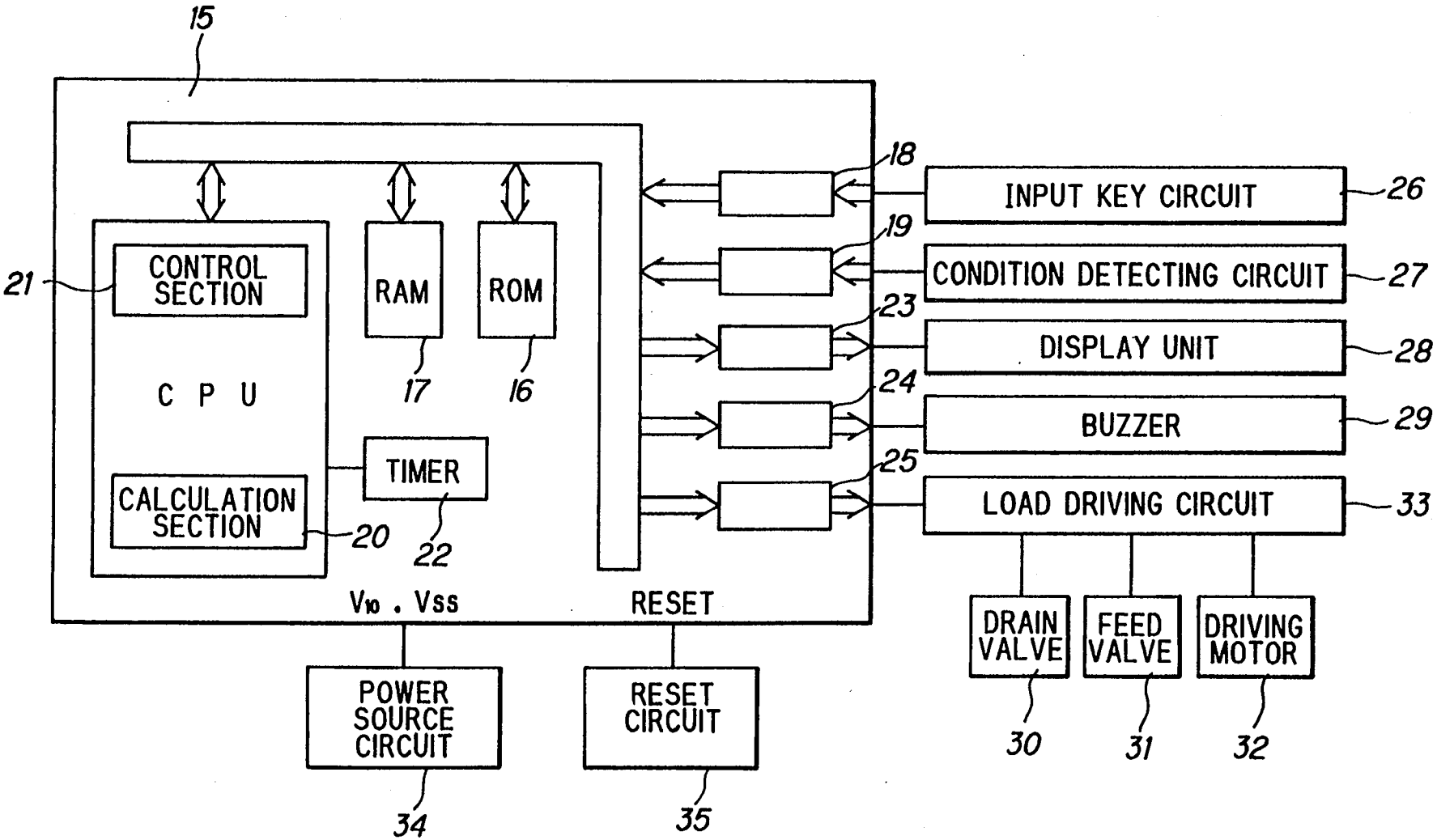
FIG. 5 is a block diagram showing one example of a control section in a washing machine of the present invention.

FIG. 5 is a block diagram showing one example of a control section in the washing machine of the present invention. Referring to FIG. 5, reference numeral 15 designates a microcomputer. Microcomputer 15 includes a read-only memory (ROM) 16 in which all operation programs are stored, and a washing time, a dehydrating time or the like can be modified using the aforementioned keys 4 to 7. A random access memory (RAM) designated at 17 stores signals from the keys 2 to 12 therein through input control sections 18 and 19. Reference numeral 20 denotes a control section which serves to compare each data stored in the RAM, and to perform an addition, subtraction and the like. Reference numeral 21 indicates a control section for controlling operations of units in the microcomputer. There are further provided a timer 22, and control sections 23 to 25 for driving each component by signals fetched from RAM 17.

The microcomputer is connected to external circuits, i.e., an input key circuit 26 including key switches 2 to 12, a condition detecting circuit 27 used for detecting a water temperature, a water level, an amount of clothes, dirtiness of the clothes and the like by using sensors. There are further external circuits, i.e., a display unit 28 for displaying a time, a course and a water level, a buzzer 29 for audibly signaling an end of the operation or occurrence of an error, a load driving circuit 33 for controlling a drain valve 30, a feed valve 31, a driving motor 32 and the like, a power source circuit 34 and a reset circuit 35. All these circuits are connected to the microcomputer.

The washing machine of the present invention includes a function for automatically determining the washing time. Namely, when start switch 3 is turned on after power source switch 2 is activated, the sensors detect the water temperature, the water level and the amount of clothes and the like. As a result of the sensing and based on the preprogrammed rules, each of processing times, i.e., washing time, rinsing time and dehydrating time is determined. 0n the other hand, if the processing time for each process is desired to be set optionally, wash key 4, rinse key 5 or dehydration key 6 is pushed after power switch 2 is activated. Thus, each of the processing times can be selectively determined within a predetermined period of time. Subsequently, start switch 3 is pressed to effect each operation by the determined time.

Figure 1:
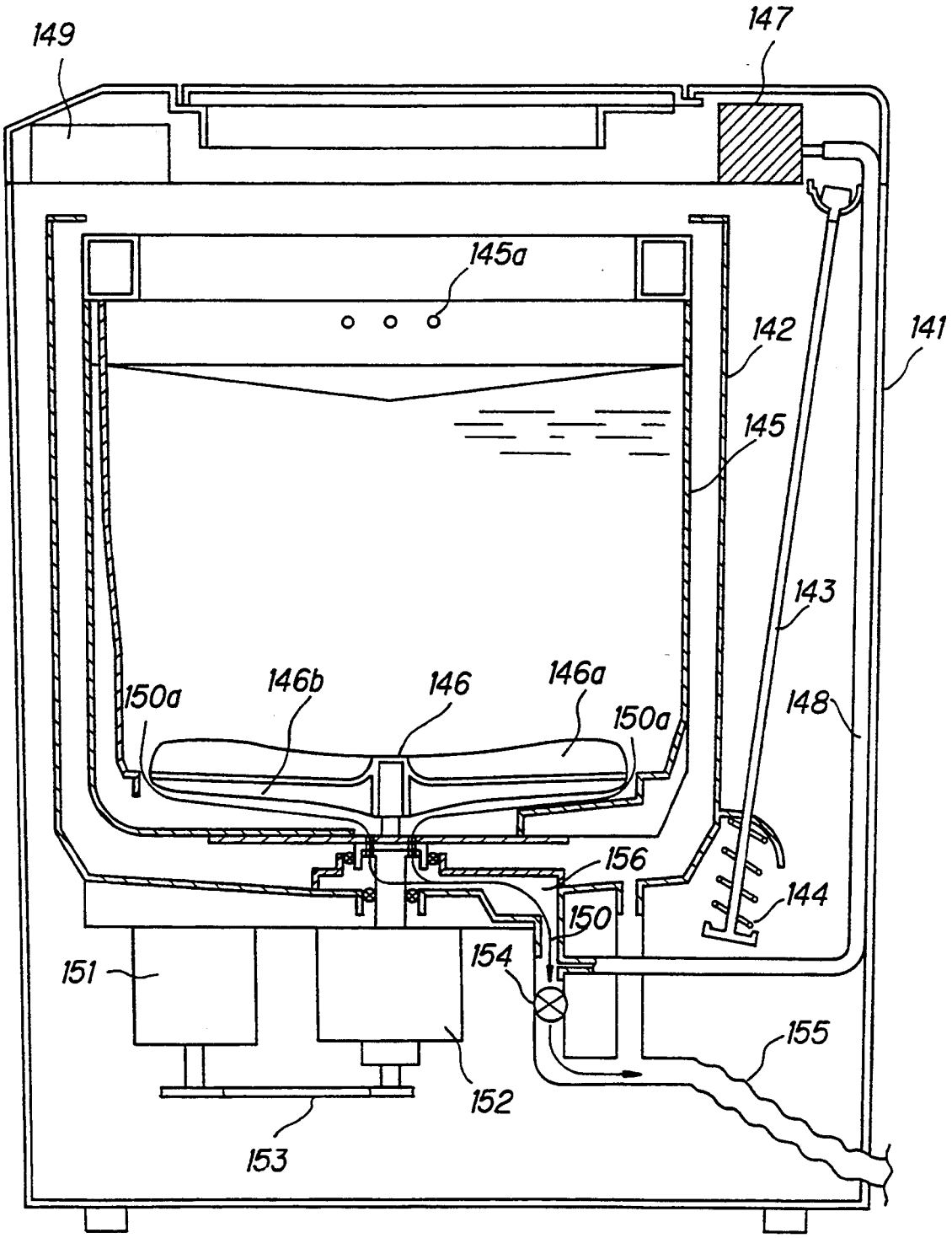
FIG. 1 PRIOR ART
FIG. 1 is a sectional view showing a structure of a prior art single-tub washing machine.
Figure 2:
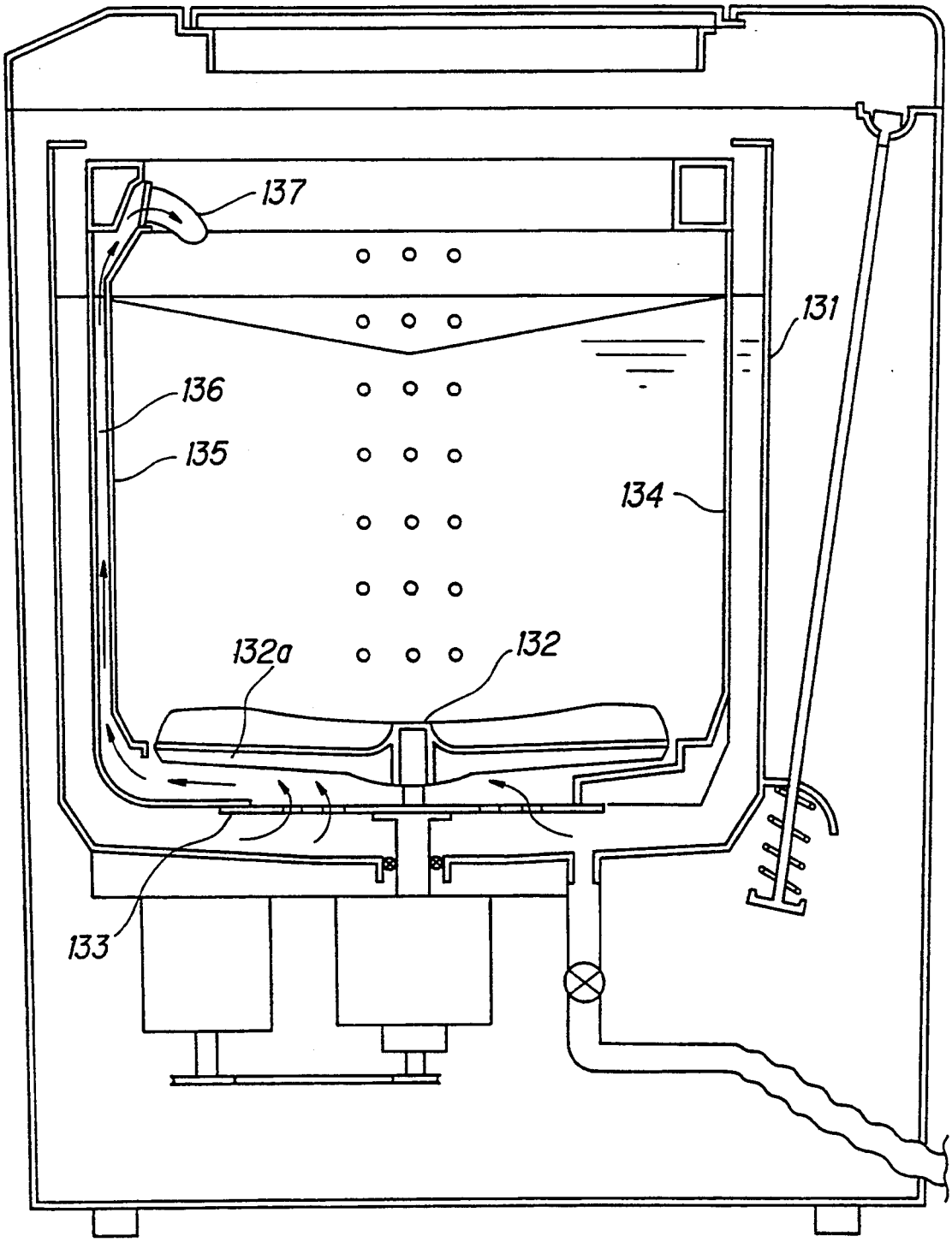
FIG. 2 PRIOR ART
FIG. 2 is a sectional view showing one example of a structure of a prior art automatic washing machine including a filter device.
Figure 3:
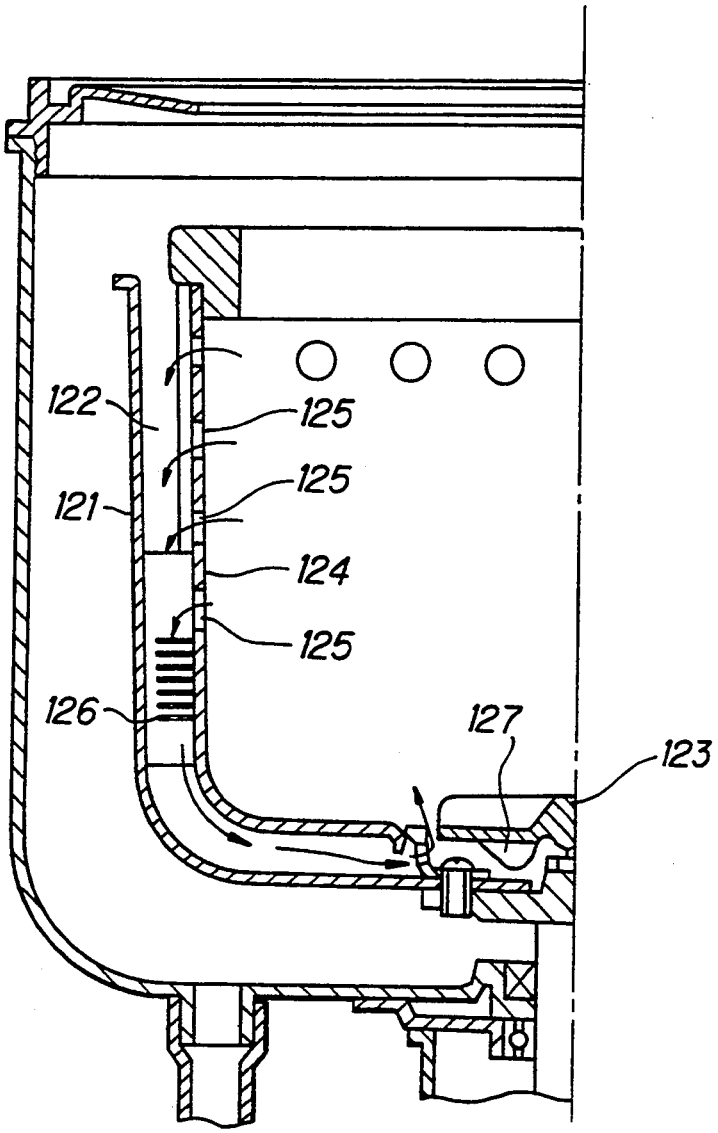
FIG. 3 PRIOR ART
FIG. 3 is a sectional view showing one example of a structure of a prior art single-tub washing machine including a filter device.

Now, a case will be considered as an example in which the washing water used in the washing process is drained before the rinsing process being started after the completion of the washing process. Referring to FIG. 1, if the wet laundries such as clothes are stuck on a portion in the course of drain path 150, or block drain holes **150*a*, air is kept in drain path, thus the pressure in air trap 156 lowers. As a result, water level sensor 147 detects the lowering of the pressure as the reset water level erroneously. To deal with such a situation, according to the present invention, if the reset water level is detected in a time interval less than a preset time interval corresponding to a water level at the start of drain (for example, 40 seconds to a middle water level), microcomputer 15 shown in FIG. 5, judging that the drain hole is blocked, immediately instructs display unit 28 and buzzer 29** to indicate an error. Alternatively, in place of indicating the error signal, the microcomputer starts a corrective operation as descried hereinafter. If the blocked condition can not be recovered for all the repetitions of the corrective operations, the error indication will be effected.

FIG. 6 is a flowchart for executing an error indication when an abnormality is detected after the start of drainage.

Initially, upon a start of drainage, the water level at the start is detected in Step 1 (S1). If the water level has reached the reset water level (YES), the operation proceeds to the dehydrating process Step 2 (S2) with no draining process. If the water remains, a time interval required for draining according to the remaining water level is defined as a drainage interval time t in Step 3 (S3). Then the drain valve is opened to discharge the water in Step 4 (S4). In step 5 (S5), the water level is detected after the opening of the drain valve at Step 4. In Step 6 (S6), if the water level reaches the reset water level (YES), the operation proceeds to Step 7 (S7), in which an actual time interval T taken from the opening of the drain valve to the detection of the reset water level is determined. If the time interval T is greater than the drainage time interval t, the operation proceeds to Step 8 (S8), in which the dehydration is performed. If the time interval T is less than the time interval t, the operation proceeds to Step 9 (S9) in which an error is signaled immediately to a user through display unit 28 or by a sound from the buzzer 29. Then, the operator should take an optional measure such as relocation of the wet laundries, etc.

FIG. 7 is a flowchart for performing a corrective operation when an abnormality is detected after the start of drainage and for displaying an error if the abnormality can not be corrected. As shown in the chart, the procedures from the start of drainage to Step 8 (S8) are identical with those in FIG. 6, but in this case, if the time interval T between the opening of the drain valve and the detection of the reset water level is judged as being less than the drainage internal time t in Step 8 (S8), the operation proceeds to Step 10 (S10), in which the corrective operation will be executed. That is, the drain valve is closed in Step 11 (S11), and the pulsator is turned to the right and left for a certain time-period (for example, five seconds), in order to relocate the wet laundries such as clothes. This correcting operation is intended to remove the closure of the drain holes. Then, the corrective operation is followed by the detection of the water level at Step 14 (S14) to proceed to Step 15 (S15) in which it is decided whether or not the water level is judged as the reset water level. If the reset water level is detected at Step 15, the operation goes through Step 16 (S16) and Step 17 (S17) to return to Step 15. This loop operation will be repeated four times as long as the water level is judged as the reset water level at Step 15. If the reset water level is still detected after the fourth corrective operation, it is decided that it is impossible to correct, and the error is displayed in Step 9.

On the other hand, if the water level other than the reset water level is detected after the corrective operation, the operation goes to Step 3 (S3) in which the same procedures designated by (A) in FIG. 6 are effected, to be followed by Step 4 (S4), in which the drain valve is opened to discharge the water. Hereinafter, Steps 5 to 9 are operated in a similar manner, that is, if the reset water level is detected within the predetermined time interval, the correction is decided to be impossible, and the error is displayed in Step 9. The error is displayed on display unit 28 or informed by the sound from buzzer 29 as stated heretofore. The user, following the indication, should take a suitable action such as relocation of the wet laundries in the dehydrating tub.

As the washing machine is constructed as detailed heretofore, the microcomputer controls the corrective operation to ensure that no dehydrating process is performed when the water is not completely drained even if the drain holes are blocked by the wet laundries during the drain process. Consequently, accidental abnormal vibration can be evaded, and therefore, it is possible to avoid deterioration of rinse performance due to a reduced dehydration efficiency as well as to prevent the lowering of the dehydration efficiency in the final dehydration process. In some cases, when an enhanced waterproof fabric and the like are washed, the dehydration efficiency would not be improved if the corrective operation is effected. In such cases, the user is informed of the failure by the error indication at an early stage, so that the washing process can be rapidly ended without a waste of time and water.

Another embodiment of the present invention will be described in detail with reference to the drawings.

Figure 8:
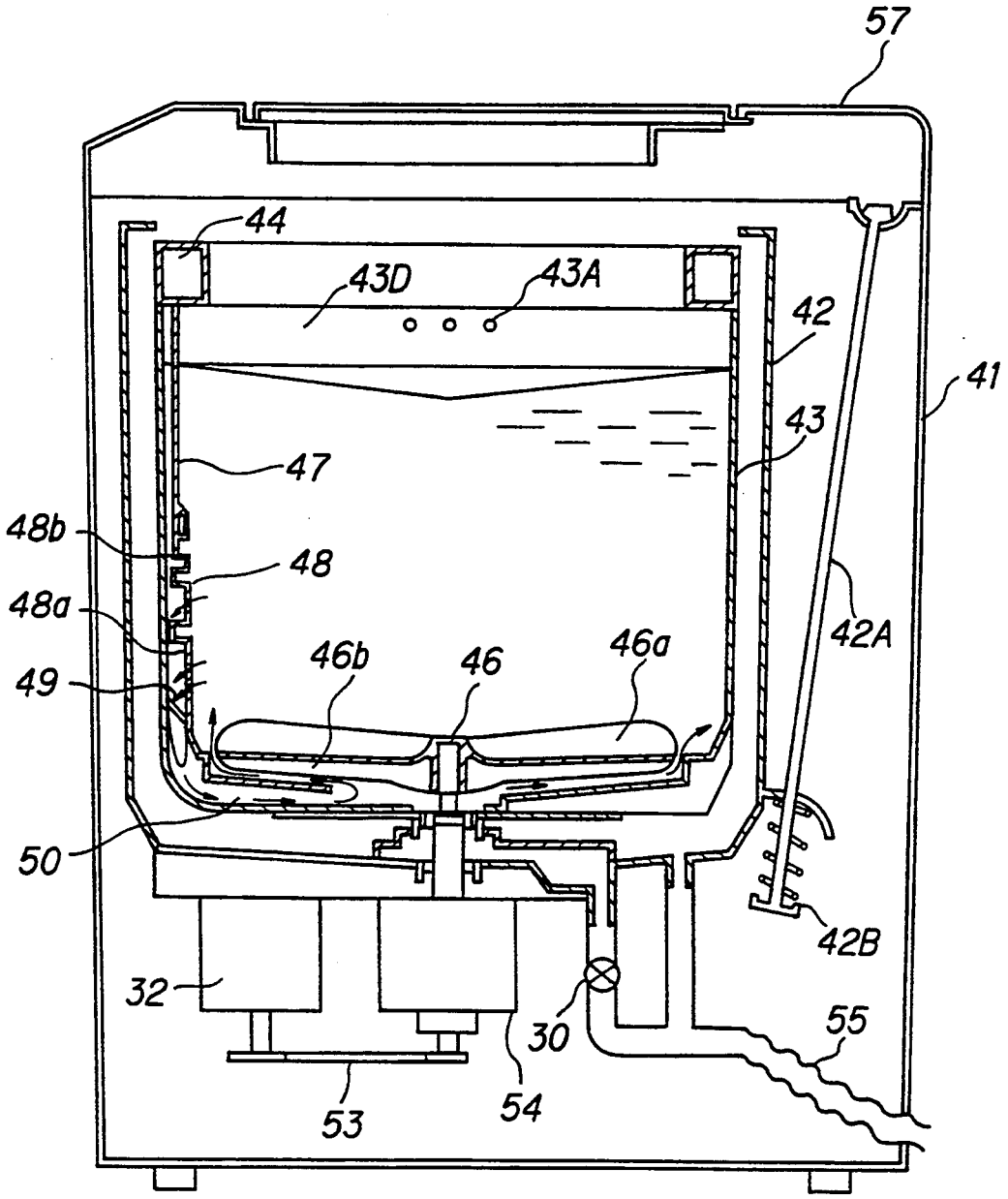
FIG. 8 is a vertical sectional view showing a structure of another embodiment of a washing machine of the present invention.
Figure 9:
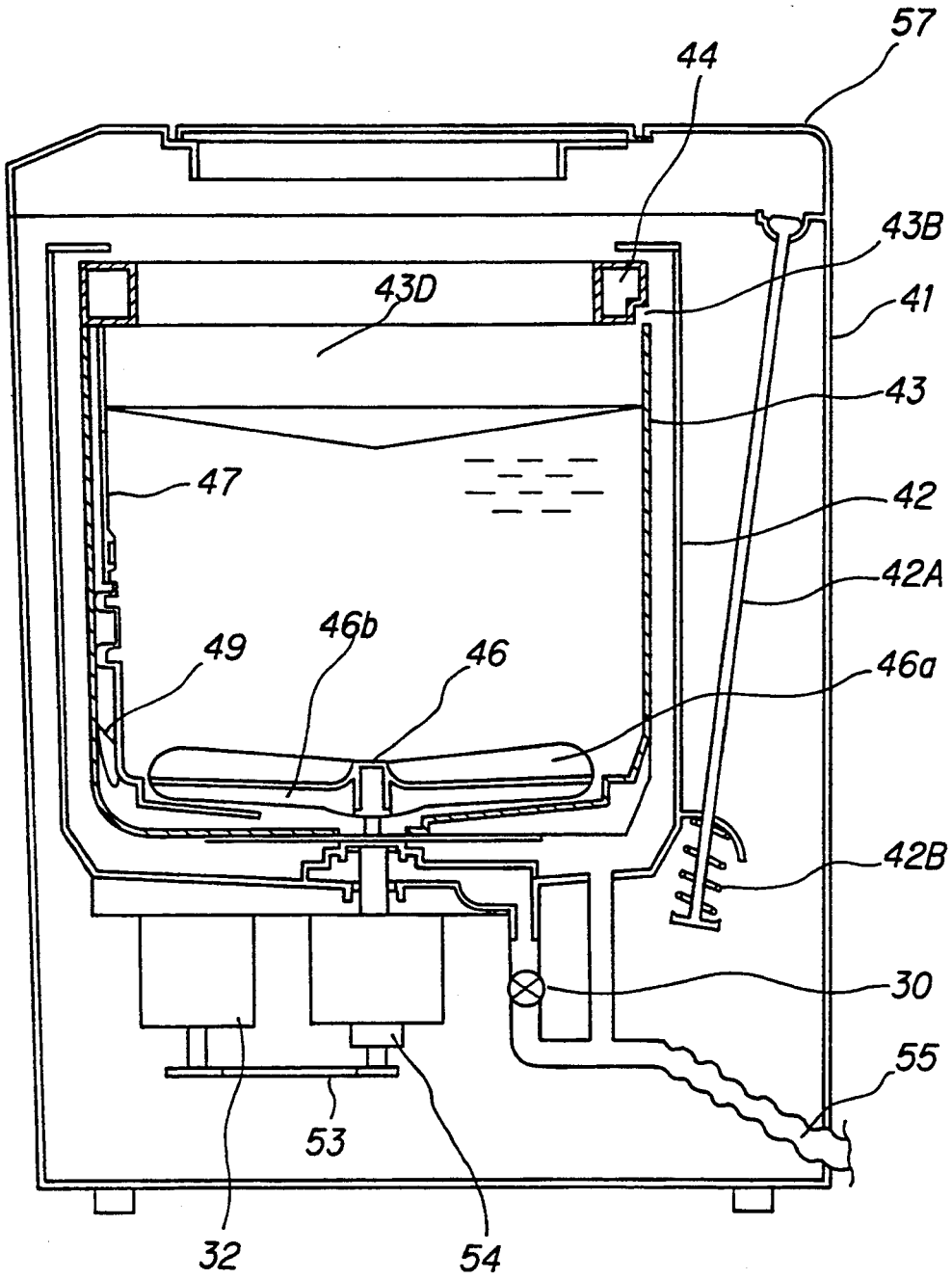
FIG. 9 is a vertical sectional view showing a variational structure of the embodiment of the washing machine shown in FIG. 8 of the present invention.
Figure 10:
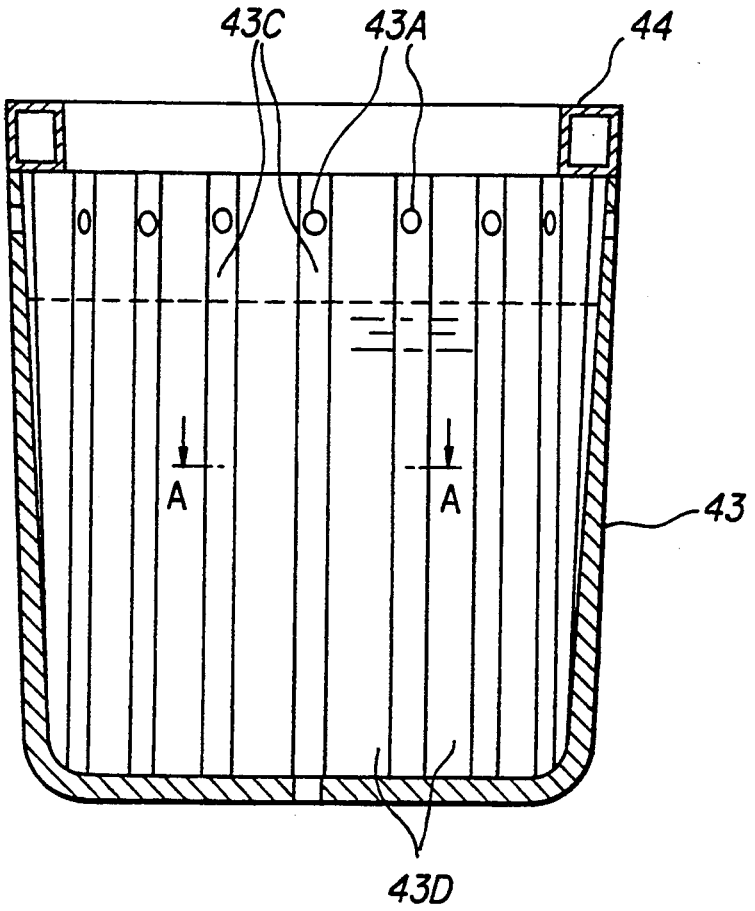
FIG. 10 is a vertical sectional view showing one example of a washing/dehydrating tub for use in a washing machine of the embodiment shown in FIG. 8.
Figure 11:
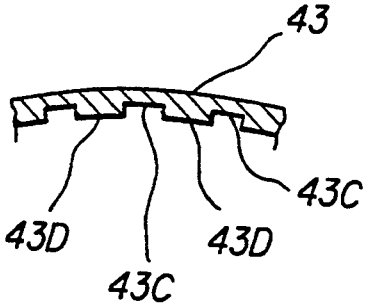
FIG. 11 is an A—A section of FIG. 10.
Figure 12:
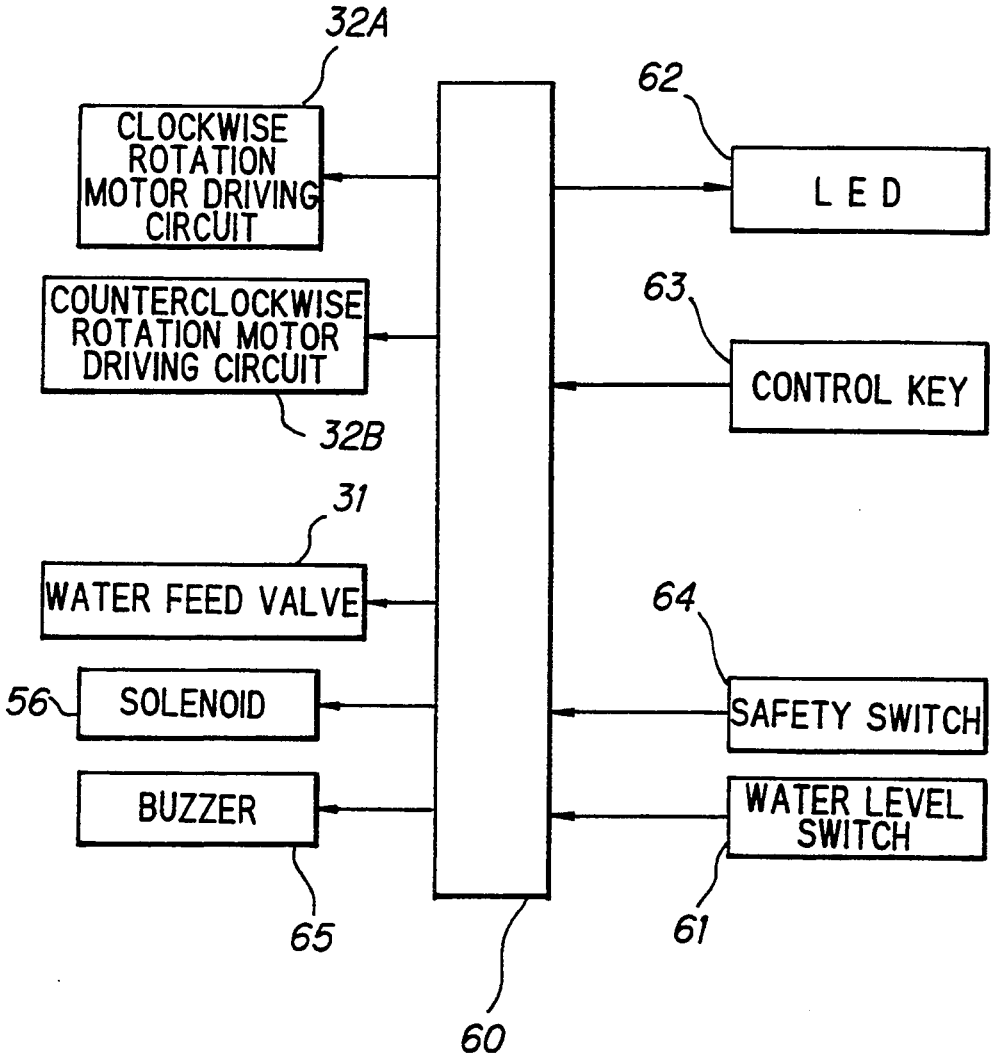
FIG. 12 is a block diagram showing an example of a control circuit of the embodied washing machine shown in FIGS. 8 and 9.
Figure 13A:
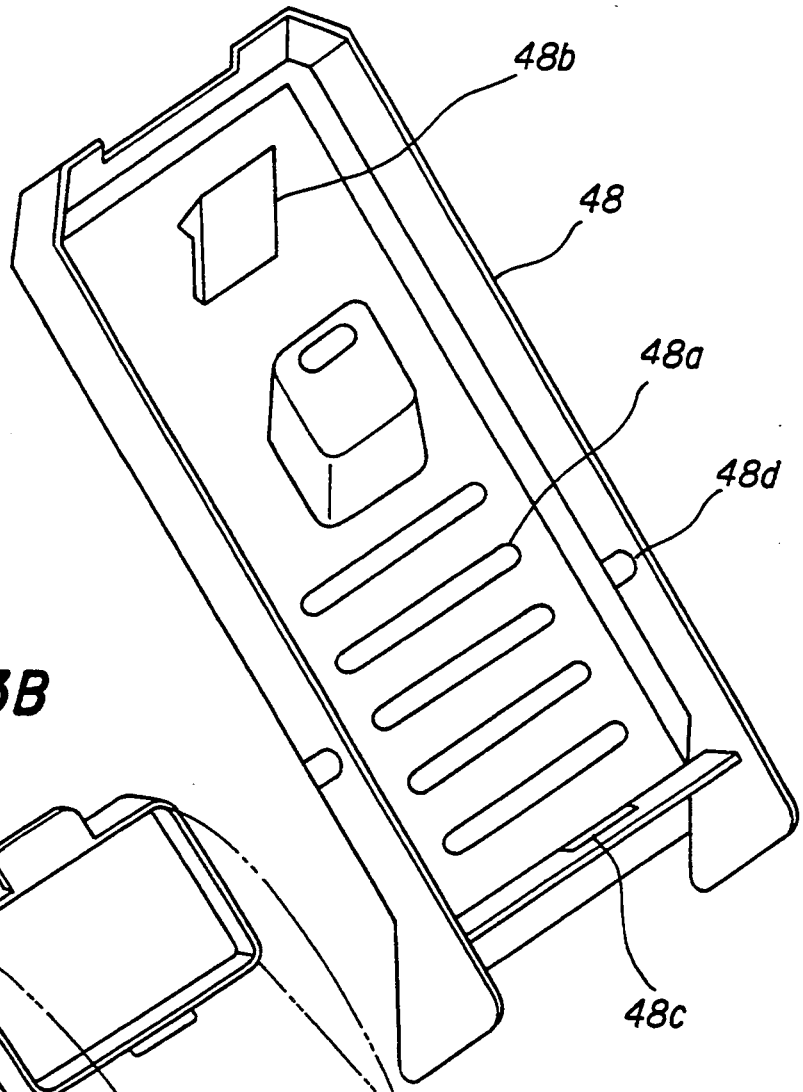
FIG. 13A is a perspective view showing an embodiment of a filter case used in a washing machine of the present invention.
Figure 13B:
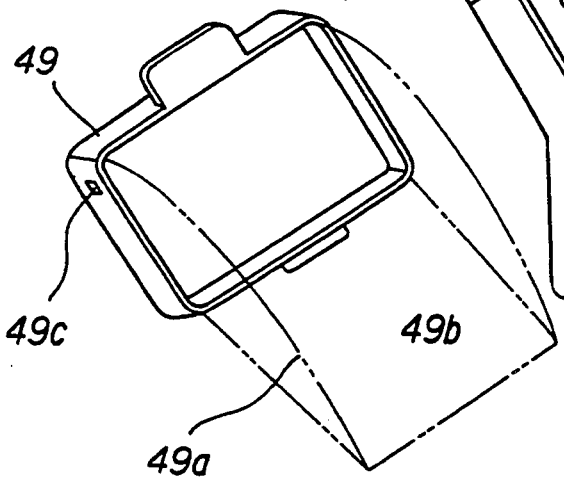
FIG. 13B is a perspective view showing an embodiment of a lint filter used in a washing machine of the present invention.

FIG. 8 is a vertical sectional view showing a structure of another embodied single-tub washing machine of the present invention, and FIG. 9 is a vertical sectional view showing a variational structure of the embodiment of the washing machine shown in FIG. 8. FIG. 10 is a vertical sectional view showing one example of a washing/dehydrating tub for use in the embodied washing machine shown in FIG. 8 and FIG. 11 is an A—A section of FIG. 10. Further, FIG. 12 is a block diagram showing an example of a control circuit of the embodied washing machine shown in FIGS. 8 and 9. Still, FIGS. 13A and 13B are perspective views showing an embodiment of a lint filter used in a single-tub washing machine of the present invention.

In FIG. 8, reference numeral 41 designates a box-like housing of the washing machine, which contains and elastically suspends a dehydrated water receiving tub 42 by plural vibration protecting mechanisms each composed of a supporting rod 42A and a spring 42B. Reference numeral 43 designates a washing/dehydrating tub for accomplishing both washing and dehydration and the tub 43 has a peripheral wall with no hole at least other than the upper portion thereof and is mounted rotatably in the dehydrated water-receiving tub 42. A pulsator 46 is mounted rotatably on the central bottom of washing/dehydrating tub 43 and provided with a washing impeller 46*a* on the front side thereof and a pumping impeller 46*b* on the back side thereof. Washing/dehydrating tub 43 has a peripheral wall 43D with no hole and is formed with dehydration holes 43A only in the upper portion thereof. Provided on peripheral wall 43D are a plurality of grooves 43C extending vertically as shown in FIG. 10.

Peripheral wall 43D is tapered at a ratio of 1/60 to 1/40, and grooves 43C are also tapered at ratio of 1/60 to 1/40. The taper ratio of grooves 43C is to be taken greater than that of peripheral wall 43D. For example, if the taper ratio of peripheral wall is 1/60, the taper ratio of grooves 43C is effectively taken 1/50. A balancer 44 is provided in the upper opening portion of washing/dehydrating tub 43.

Washing/dehydrating tub 43 is provided with a filter cover 47 in one portion of the side surface thereof. According to an embodied example shown in FIG. 8, filter cover 47 is provided to form a water driving channel 50 for the pumping operation of pulsator 46. A filter case 48 is mounted on filter cover 47 to attach a lint filter 49. As shown in FIG. 13A, filter case 48 is provided with a plurality of slit holes 48*a* through which water passes and reference numeral 48*b* designates a claw allowing the case to be attached and detached. Attachment of lint filter 49 to filter case 48 is carried out such that, as shown in FIG. 13B, an insert 49*b* is fitted into a socket 48*c* while a spherical projection 49*c* is engaged with amounting hole 48*d*. Reference numeral 32 is a driving motor, which drives washing/dehydrating tub 43 and pulsator 46 through a belt 53 and mechanism portion 54.

It is one of the essence of the present invention that a water driving channel 50 is defined by filter cover 47 so as to extend down to a lower portion of pulsator 46. With this arrangement, there is no collision between a sucked-in flow and an ejected flow as is apparent from FIG. 8, so that sucking efficiency is hardly lowered.

This fact improves a collection efficiency of lint or other dust. In this case, an end of water driving channel 50 arranged under pulsator 46 is preferably and effectively opened in the vicinity of a substantially middle portion of a radius of pulsator 46.

In the embodiment of the invention as shown in FIG. 8, diving channel 50 is formed by filter cover 47 from the side surface of washing/dehydrating tub 43 to the lower portion of pulsator 46. However, in order to allow the diameter of washing/dehydrating tub 43 to be varied for, providing, for example, a series of the washing machines having different capacities, a water driving channel 50 under pulsator 46 may be constructed by a separate part independent of filter cover 47. This modification does never affect the performance, and the present invention is naturally intended to include such variations although they are not illustrated in particular.

Next, description will be given of the operation of the embodiment shown in FIG. 8 and FIGS. 13A and 13B of the present invention.

In the washing process, water is supplied based on the amount of clothes, pulsator 46 is started to turn to cause a water current in washing/dehydrating tub 43 by means of washing impeller 46*a*, thus performing washing. At the time, pumping impeller 46*b* of pulsator 46 causes a current in washing/dehydrating tub 43 to be sucked into the lower portion of pulsator 46. Specifically, the washing water passes through flow-slit holes 48*a* of filter case 48 via lint filter 49, and is sucked in via water driving channel 50 toward the lower portion of pulsator 46 by pumping impeller 46*b* while the washing water is ejected from an outer peripheral channel of pulsator 46 by impeller 46*b*.

The lint, generated in washing, and floating in the washing water, is conveyed by the water current set forth and can be surely collected through a sack-shaped net portion 49*a* of lint filter 49. The collected lint can be easily removed by detaching filter case 48 and lint filter 49.

In dehydrating, the washing water is drained through drain valve 30 and the washing/dehydrating tub 43 is turned at a high speed. Accordingly, the water is dehydrated by centrifugal forces through dehydration holes 43A disposed in the upper portion of washing/dehydrating tub 43 into dehydrated water-receiving tub 42. Thus, the washing water is drained out from the washing machine through drain hose 55.

With the structure described heretofore, even fine lint can be surely collected and it is possible to enhance the efficiency of the pumping operation of pulsator 46.

In the upper boundary portion of washing/dehydrating tub 43, or a position above a typical high water level in washing, a plurality of dehydration holes 43A are disposed on peripheral wall 43D.

Disposed in the external face of the bottom of dehydrated water-receiving tub 42 is a driving motor 32 or a mechanism portion 54 having a shaft bearing, for causing pulsator 46 to turn at a low speed (about 180 rpm) intermittently in alternate forward and reverse directions and allowing washing/dehydrating tub 43 and pulsator 46 together to spin at a high speed.

An outlet port of washing/dehydrating tub 43 is disposed on the bottom face of dehydrated water-receiving tub 42, and is communicated through the drain path to drain valve 30. Water that is extracted by the steady rotation (at about 800 rpm) of washing/dehydrating tub 43 in the dehydration step is discharged from a drain hose 55 provided in the bottom portion of dehydrated water-receiving tub 42.

Drain valve 30 is connected to a solenoid 56 as shown in FIG. 12, and will be opened to discharge the water held in washing/dehydrating tub 43 when the solenoid 56 is activated. At the same time, a clutch device (not shown) mounted in bearing mechanism 54 is operated to transmit the rotation of a driving motor 32 to a rotary blade 46*b* and washing/dehydrating tub 43 while releasing a braking mechanism (not shown) of washing/dehydrating tub 43.

Reference numeral 57 designates a top board, to which a water feed valve 31 for supplying water into washing/dehydrating tub 43, a control circuit and other elements are attached. The control circuit is connected to a microcomputer 60, typical output means, and typical input or setup means.

Motor driving circuits 32A and 32B control driving motor 32 with reference to the output signals from microcomputer 60. A water level switch 61 is provided on top board 57 to detect a water level in washing-/dehydrating tub 43. The electric signal detected is input to microcomputer 60.

Further, a plurality of LED's 62 (light emitting diodes) are used to display the operation state of the washing machine, while the control of the washing machine is performed by the input of keys 63. At the completion of the operation or upon the occurrence of abnormal operation, a buzzer 65 and other means are activated to inform the user of a particular matter.

In case an abnormal vibration occurs during the dehydration proceeding, the event is detected by a safety switch 64 so that an electric signal is input to microcomputer 60, and the measure against it is taken.

In the draining step after washing or rinsing process, when the washing water is discharged and the water surface comes down to a predetermined level, washing-/dehydrating tub 43 is controlled to spin while the discharge of water goes on, in order to increase the dehydration efficiency by inhibiting the vibration occurring in the dehydrating process.

As to the above-state rotating of washing/dehydrating tub 43, it is effective that the tub is rotated by a steady mode at a high speed in a first predetermined period and then is rotated at a low speed until the extraction of water is completed.

FIG. 9 is a vertical sectional view showing a variational structure of the embodiment of the washing machine shown in FIG. 8 of the present invention, and the basic structure of FIG. 9 is generally similar to that of FIG. 8, but differs in that the peripheral wall 43D of the washing/dehydrating tub 43 has no hole and is provided with dehydration clearance 43B between the washing/dehydrating tub 43 and a balancer 44 disposed above washing/dehydrating tub 43.

The above washing/dehydrating tub 43 also has vertical grooves 43C for lifting water formed on peripheral wall like the case of FIG. 8, and each groove is formed as shown in the sectional view of FIG. 11 and extends from the bottom portion to an upper position on the side wall corresponding to respective clearance 43B. As to the grooves 43C for lifting water, grooves 43C are tapered at ratio of 1/60 to 1/40 in the same manner as set forth while peripheral wall 43D is tapered at a ratio of 1/60 to 1/40. In addition, the taper ratio of grooves 43C is taken greater than that of peripheral wall 43D. For example, if the taper ratio of peripheral wall is 1/60, the taper ratio of grooves 43C is to be taken 1/50.

In a washing machine of the embodiments described heretofore, the inner tub 43 with grooves 43C is constructed such that a relation between the total width NL of all the grooves 43C and the inside circumference ($2\pi R$) of the inner tub 43 suffices $NL \geqq 2\pi R/9$, or the ratio of NL to $2\pi R$ is 1/9 or more. Here, N and L indicate the number of the grooves 43C and a width of each groove, respectively, and R is a radius of the inner tub 43. Thus, it is possible to improve the dehydration efficiency by forming the inner tub with the ratio of the total width of grooves 43C to the circumference of peripheral wall 43D being 1/9 or more.

Here, in each of the dehydration operations conducted three times respectively after the wash process, the first rinse process, the second rinse process, washing/dehydrating tub 43 is started to rotate when the water is discharged and the water level reaches a preset level that is lower than the water level at washing or rinsing. In this while, drain valve 30 remains opened so that the water is gradually reduced. On the other hand, the water current (or water waves) generated by the rotation of washing/dehydrating tub 43 and pulsator 46 allows the twisted laundries after washing or rinsing operation to be disentangled and scattered uniformly in all over the tub.

Washing/dehydrating tub 43 used here is constructed with a peripheral wall 43D having no hole except in the upper portion, or with a peripheral wall 43D that has no hole completely. Therefore, washing/dehydrating tub 43 is rotated with keeping the water therein even while the water is being discharged. Consequently, the weight of the water or the inertia inhibits washing/dehydrating tub 43 from vibrating and the tub rotates slowly.

Now, the rotating speed will be described. Since driving motor 32 bears a heavy load due to the weight of the water in washing/dehydrating tub 43 when the rotation is started, the driving motor will be operated in the steady rotation mode though it is a very short, in order to assure the starting stability of driving motor 32. Then, the motor 32 is run for a while (to reach a particular speed), and the driving mode is changed to the controlled driving mode by waveform control. By this regulation, washing/dehydrating tub 43 is driven at a lower rotational speed (specifically, 250 to 280 rpm in the intermittent waveform control) than that in the steady driving mode. In this while, if the tub is rotated at a high speed, the inside of the tub develops into a dehydration state even in the draining state, so that the laundries in the tub, being affected by the centrifugal force, are hard to be kept inside the tub, and thus the laundries are liable to make an imbalanced state. For this reason, the period of the starting steady driving is preferably as short as possible.

Figure 14:
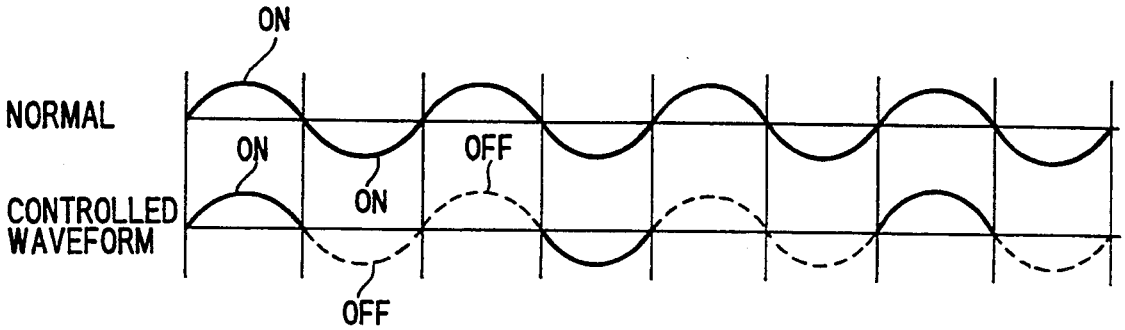
FIG. 14 is a schematic chart for explaining a method of a waveform control in which a waveform is generated from an original waveform by eliminating a part of the original waveform at intervals for performing a low speed rotation during the hydrating operation.

The waveform control for driving the motor at a low speed, can be carried out such that, for example, a part of the sinusoidal wave is eliminated (or made not to be applied) at intervals to falsely change the frequency of the current applied to driving motor 32. This method enables the motor to run as if the motor were driven by a power supply having a frequency lower than that of the actual power supply. Using this method, it is possible to generate a frequency different from the original frequency of the power supply (see FIG. 14).

The state made by the control set forth above is kept on until the water in washing/dehydrating tub 43 is totally discharged. When a water level switch 61 detects that the water in washing/dehydrating tub 43 is completely drained, the waveform control of driving motor 32 is terminated, and the motor is driven normally and increased in the speed up to a steady rotational speed (about 800 rpm). Then, the steady driving is kept to conduct the dehydration process until the setup time is over.

Meanwhile, the centrifugal force generated inside washing/dehydrating tub 43 in dehydrating can be given by a formula: $F=R\omega^2$ (R: a radius of the inner tub, $\omega$: an angular velocity defined by $2\pi N/60$ where N is a rotational frequency), and in practice the centrifugal force exerted inside the above washing/dehydrating tub 43 is adapted to be 1500 newtons or more.

The peripheral wall 43D and grooves 43C in the aforementioned washing/dehydrating tub 43 are tapered at ratios of 1/60 to 1/40 and the taper ratio for grooves 43C is adapted to be greater than that for the wall of washing/dehydrating tub 43. Therefore, the washing water contained in clothes is extracted and removed along grooves 43C, while the laundries are pressed against the wall of washing/dehydrating tub 43 without being raised upward of washing/dehydrating tub 43 together with the flow of the washing water to be dehydrated, or without blocking dehydration holes 43A. Accordingly it is possible to improve the dehydrating efficiency to a great extent. With regard to the movement of the water when the dehydration proceeds, the water receives a component of the centrifugal force created by the taper, so that the washing water is raised along the grooves 43C of washing/dehydrating tub 43. Thus rising water is discharged to dehydration holes 43A or clearance 43B disposed in positions corresponding to grooves 43C, and is collected in dehydrated water-receiving tub 42 to be drained from the machine.

Figure 15:
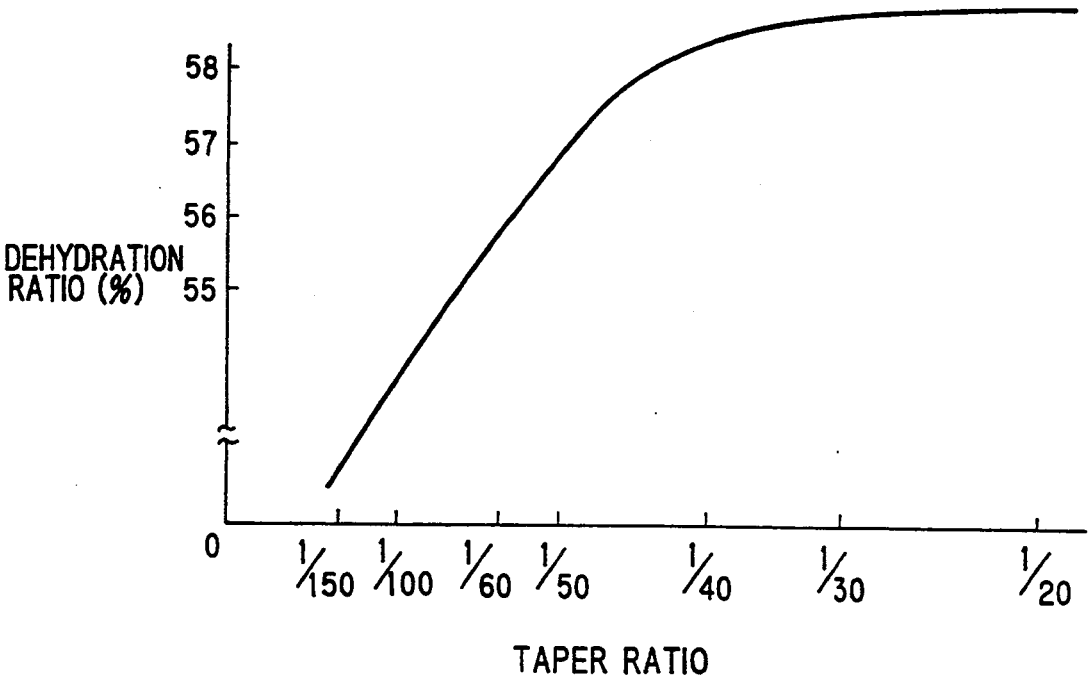
FIG. 15 is an experimentally determined characteristic chart showing a relational behavior of a dehydration proportion to variation of a taper of a peripheral wall of a washing/dehydrating tub used in a washing machine of the present invention.
Figure 16:
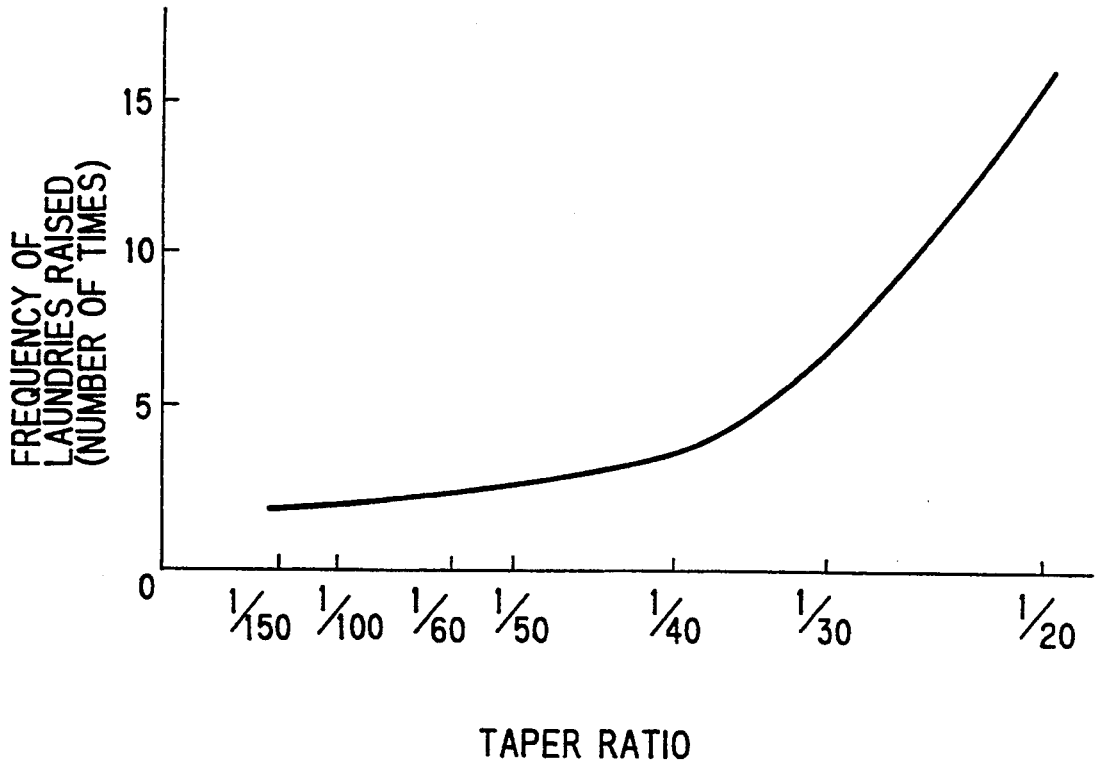
FIG. 16 is an experimentally determined characteristic chart showing a relation of a rising frequency of the laundries to the taper ratio of a peripheral wall of a washing/dehydrating tub use in a washing machine of the present invention.

In the invention, experimentally determined was a relational behavior of dehydrating ratio to variation of a taper of washing/dehydrating tub 43 as well as a behavior of rising frequency of the laundries to the taper ratio. The obtained result is shown in FIGS. 15 and 16. That is, FIG. 15 is a characteristic chart showing a relational behavior between the dehydrating ratio and the taper, whereas FIG. 16 is a characteristic chart showing a relation between the rising frequency of the laundries and the taper.

As is apparent from FIG. 15, with only regard to the dehydrating ratio, the greater the taper is, the more is the dehydrating ratio increased. In contrast, as is clearly understood from FIG. 16, as the taper becomes large, the laundries are raised more frequently in place of being pressed against peripheral wall 43D of washing/dehydrating tub 43. Therefore, the aforementioned dehydration holes 43A or clearance 43B for dehydration may be blocked by the washing. As a result, this not only lowers the dehydrating ratio to be lowered, but also may cause an extremely large vibration due to the higher position of the laundries.

On the basis of the experiments described above, the taper ratio of peripheral wall 43D of washing/dehydrating tub 43 is set up as being 1/60 to 1/40 in the invention.

In the washing/dehydrating tub 43 described above, if grooves 43C were provided such that the total width NL of grooves 43C suffices the relation: $NL \geqq 2\pi R/9$ with peripheral wall 43D tapered, for example, at a ratio of 1/60 and grooves 43C tapered at 1/50 (larger than the taper ratio of peripheral wall 43D), the dehydrating efficiency of the wet laundries in dehydrating was confirmed from the experimental result as to be equal to a dehydrating efficiency obtained in a case in which a washing/dehydrating tub 43 without grooves with the peripheral wall 43D tapered at 1/50.

In other words, the above result shows that, as is also understood from FIG. 15, the configuration of the invention can provide a dehydrating efficiency of about 56% to 58%, which surpass the average dehydrating efficiency of typical washing machines, i.e., 55%.

As has been described heretofore, according to the invention, if the wet laundry blocks the dehydration holes during the dehydration process, a corrective operation effected by the microcomputer control can prevent the execution of dehydrating with default of draining. Therefore, accidental abnormal vibration can be prevented, and the lowering of rinsing performance due to a reduced dehydrating ratio as well as the lowering of the dehydrating efficiency at the final dehydration can be prevented. Further, in a case where washing of an enhanced waterproof fabric and the like inhibits the dehydration efficiency from being improved even if the corrective operation is effected, the error indication in an early stage informs the user of the failure, so that it is possible to rapidly terminate the washing process without a waste of time and water.

Moreover, according to the invention, it is possible to surely collect fine lint and dust and it is also possible to enhance the pumping efficiency of the pulsator to a greatest degree. Thus, the practical effect of the invention is markedly distinct.

What is claimed is:

1. A single-tub washing and dehydrating machine, comprising:

a washing/dehydrating tub, having a peripheral wall with no hole except with dehydration holes or dehydrating clearance disposed in the vicinity of the upper boundary thereof, having a drain hole disposed in the bottom portion thereof, and being spun when dehydration is effected;

a pulsator having a pumping impeller on the back side thereof, disposed in the bottom of said washing-/dehydrating tub for agitating water with laundries to be washed when washing is effected; and a dehydrated water-receiving tub holding and enclosing said washing/dehydrating tub;

said drain hole discharging water while being communicated with a drain pipe sealingly against said dehydrated water-receiving tub, said single-tub washing and dehydrating machine, further comprising a microcomputer control means which, when said drain hole is blocked with laundries to be dehydrated in a dehydrating process to cause reduction of pressure inside an air trap and thereby a reset water level is detected erroneously, provides an error indication immediately after the detection, or controls said pulsator to effect a predetermined corrective operation for correcting the position of the laundries to be dehydrated inside said washing/dehydrating tub and thereafter provides an error indication if the correction is judged as impossible.

2. A single-tub washing and dehydrating machine, comprising:

a washing/dehydrating tub, having a peripheral wall with no hole except with dehydration holes or dehydrating clearance disposed in the vicinity of the upper boundary thereof, having a drain hole disposed in the bottom portion thereof, and being spun when dehydration is effected;

a pulsator having a pumping impeller on the back side thereof, disposed in the bottom of said washing-/dehydrating tub for agitating water with laundries to be washed when washing is effected; and a dehydrated water-receiving tub holding and enclosing said washing/dehydrating tub;

said drain hole discharging water while being communicated with a drain pipe sealingly against said dehydrated water-receiving tub, said single-tub washing and dehydrating machine, further comprising: a microcomputer control means which, when said drain hole is blocked with laundries to be dehydrated in a dehydrating process to cause reduction of pressure inside an air trap and thereby a reset water level is detected erroneously, provides an error indication immediately after the detection, or controls said pulsator to effect a predetermined corrective operation for correcting the position of the laundries to be dehydrated inside said washing/dehydrating tub and thereafter provides an error indication if the correction is judged as impossible;

a filter cover defining a water driving channel from a portion of the side wall of said washing/dehydrating tub to a bottom portion underneath said pulsator;

a filter case having a plurality of slit holes being provided in a lower portion of said filter cover detachably therefrom; and a lint filter having a sack-shaped net, disposed in a space defined by said washing/dehydrating tub, said filter cover and said filter case and fitted detachably to said filter case.

3. A single-tub washing and dehydrating machine, comprising:

a washing/dehydrating tub, having a peripheral wall with no hole except with dehydration holes or dehydrating clearance disposed in the vicinity of the upper boundary thereof, having a drain hole disposed in the bottom portion thereof, and being spun when dehydration is effected;

a pulsator having a pumping impeller on the back side thereof, disposed in the bottom of said washing-/dehydrating tub for agitating water with laundries to be washed when washing is effected; and a dehydrated water-receiving tub holding and enclosing said washing/dehydrating tub;

said drain hole discharging water while being communicated with a drain pipe sealingly against said dehydrated water-receiving tub, said single-tub washing and dehydrating machine, further comprising a microcomputer control means which, when said drain hole is blocked with laundries to be dehydrated in a dehydrating process to cause reduction of pressure inside an air trap and thereby a reset water level is detected erroneously, provides an error indication immediately after the detection, or controls said pulsator to effect a predetermined corrective operation for correcting the position of the laundries to be dehydrated inside said washing/dehydrating tub and thereafter provides an error indication if the correction is judged as impossible, being characterized in that said washing/dehydrating tub has a plurality of vertical grooves on the peripheral wall thereof, said grooves has a taper ratio different from and larger than a taper ratio of said peripheral wall, both the taper ratios of said grooves and said peripheral wall are limited within 1/60 to 1/40, and said washing/dehydrating tub with grooves is constructed such that a relation between the total width NL of all the grooves and the inside circumference ($2\pi R$) of said washing-/dehydrating tub suffices $NL \geqq 2\pi R/9$, or the ratio of NL to $2\pi R$ is 1/9 or more, where N and L indicate the number of the grooves and a width of each groove, respectively, and R is a radius of said washing/dehydrating tub.

* * * * *